United States Patent [19]

Francis

[11] 4,361,290

[45] Nov. 30, 1982

[54] ADJUSTABLE ROTARY CRUSHER

[76] Inventor: Peter M. Francis, 4126 Salmon Dr., Orlando, Fla. 32811

[21] Appl. No.: 162,251

[22] Filed: Jun. 23, 1980

[51] Int. Cl.[3] ..... B02C 13/286

[52] U.S. Cl. ..... 241/57; 241/79.1; 241/186.3; 241/189 R

[58] Field of Search ..... 241/19, 24, 49, 57, 241/69, 27, 31, 79.1, 186.2, 186.3, 186 R, 285 B, 285 A, 189 R

[56] References Cited

U.S. PATENT DOCUMENTS 3,062,458 11/1962 Dearing ..... 241/19

3,513,858 11/1966 Pietrucci ..... 131/312

4,037,796 7/1977 Francis ..... 241/59

*Primary Examiner*—Mark Rosenbaum

*Assistant Examiner*—Timothy V. Eley

*Attorney, Agent, or Firm*—Seiler & Quirk

[57] ABSTRACT

A rotary solids crusher has three product exits for selectively removing product particle sizes produced by secondary, tertiary, or fine grind crushing. In the fine grind mode, the crusher has an unobstructed vertical attrition chamber from which air-entrained particles exit at high velocity, and are subsequently classified by particle size using the energy inherent in the rapidly moving stream to effect settling; e.g., by gravity or in centrifugal separators.

3 Claims, 5 Drawing Figures

ADJUSTABLE ROTARY CRUSHER

BACKGROUND OF THE INVENTION

This invention relates to rotary crushers for pulverizing solid materials, and to a method and system for classifying the pulverized product. In particular, it relates to a rotary crusher having the capability with very little adjustment to provide relatively uniform product particle sizes ranging from rather large chunks to very fine powders. The invention also features a collection system for finely ground material which permits the crusher exhaust to assist in the recovery and classification of finely ground material.

Commercial crushers are required to perform a wide variety of crushing chores. For example, it may be desired to reduce the size of ordinary rock from 6"+ to $-\frac{3}{4}$" for use as paving aggregate. Alternatively, to prepare mineral-containing ore for chemical processing it may be desired to crush chunks of ore to a product size of approximately 30 mesh. In other instances, such as the pulverizing of coal for use in utility boilers, or cement manufacture, product particle sizes of 100 to 200 mesh may be required. At the present time, no single available crusher can satisfy the wide variety of product distributions and product sizes which may be desired without extensive modification. Accordingly, there is a substantial demand for a crusher which is sufficiently flexible to provide utility for a large number of feed materials and product size and distribution.

Rotary crushers of the general type disclosed herein have been described in my existing U.S. Pat. Nos. 3,887,141; 4,037,796; and 4,077,574. These patents disclose a crusher having an impact rotor positioned within a reduction chamber and having a plurality of hammerheads around its periphery. Ore entering the reduction chamber is directed tangentially against the hammers and hurled against the sides of the reduction chamber. The internal walls of the reduction chamber are lined with shatterbars which assist in reduction of the ore to a finer particle size. As particles fall to the bottom of the chamber, they are swept back into the downstream side of the reduction chamber by a rapidly moving fluidizing rotor located beneath the impact rotor. Air enters the reduction chamber through inlets in its side, and crushed particles are swept upwardly through a vertical classification chamber to permit removal of particles within certain size ranges. As shown in U.S. Pat. No. 4,037,796, particle diverter plates and air deflector flaps are used within the classification chambers to direct particles of various sizes into their proper classification.

With the prior art devices, particle size distribution is relatively fixed by the crusher design. While some flexibility exists to produce a very finely pulverized product by adjusting rotor speed, air flow, and classification chamber height, these mills can handle only a relatively narrow variety of feeds and product size distribution requirements. It has been found that with relatively minor modifications, the crusher described in U.S. Pat. No. 4,037,796 can be designed to do the work of three separate crushers; i.e., having product particle sizes corresponding to ranges generally referred to as secondary, tertiary, and fine grinding. In addition, it has been discovered that energy generated by the rotating hammers can be used to classify finely ground materials into a plurality of desired product distributions.

The crusher and classification system of the invention are characterized by the crusher having three separate and independent product takeoff points, including 2 exits used for very light crushing operations (i.e., where the product particle size is relatively large). In addition, the crusher is characterized by an offset unimpeded vertical attrition chamber, containing no deflectors or product removal means, where the attrition of rising small particles with falling larger particles creates further particle comminution. In addition, product classification from the exhaust from the crusher is effected through the use of the energy contained in the air/particle stream to assist in classifying the product. This classification may be accomplished by thrusting the product stream into a centrifugal separator, such as a cyclone collector, wherein the larger particles exit the bottom of the unit and smaller particles are carried across the top thereof. Alternatively, the product exit stream may be directed horizontally across a series of bins, with the larger particles falling by gravity into the bins nearest the exit, and smaller particle sizes falling at a greater distance from the exit.

BRIEF SUMMARY OF THE INVENTION

In a system for crushing solid particles having a housing, a particle inlet chute, an impact reduction chamber within the housing, an impact rotor having impact hammers at its periphery, a drive motor to turn the impact rotor at high velocity, a motor driven fluidizing rotor removably mounted near the bottom of the impact reduction chamber, the improvement therein which comprises an unobstructed attrition chamber having, at a lower section thereof, a vertically decreasing cross-sectional area, said attrition chamber extending vertically above the impact rotor, first product exit means located at the bottom of the impact reduction chamber, second product exit means located in a side of the housing opposite the inlet chute, and third product exit means at the upper end of the attrition chamber. In another embodiment of the invention, a particle crushing/classifying system comprises a crusher housing, a particle inlet chute, an impact reduction chamber containing a motor driven impact rotor, a fluidizing rotor, an unobstructed vertical attrition chamber having at least along a portion thereof a vertically decreasing cross-sectional area, product exit means in communication with the attrition chamber oriented to thrust an air/particle product stream in a substantially horizontal plane, and a plurality of crushed particle collection bins located at various distances from the exit to permit classification of particles by gravity flow into the various bins.

BRIEF DESCRIPTION OF THE DRAWINGS

The invention is best understood with reference to the drawings in which.

DETAILED DESCRIPTION OF A PREFERRED EMBODIMENT

Figure 1:
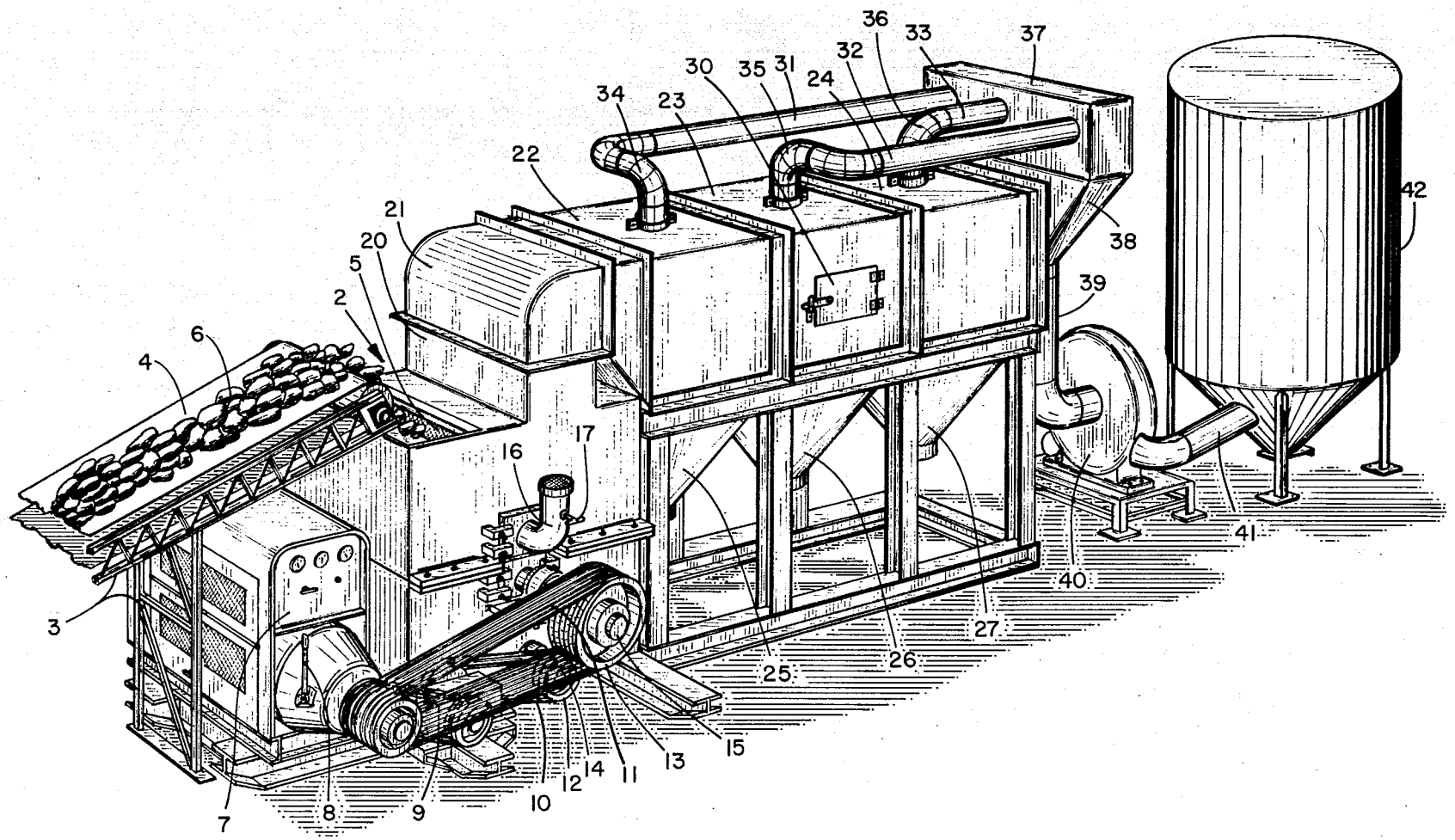
FIG. 1 is a perspective exterior view of the feed system, rotary crusher, multiple bin classification system, and dust collector (i.e., fine grinding mode)

Referring first to FIG. 1, rotary mill or crusher 2 is fed coarse material by belt feeder 4. The belt feeder is elevated on support structure 3, and is upwardly inclined, dumping the coarse feed material into the opening of feed chute 5 in the crusher.

Figure 2:
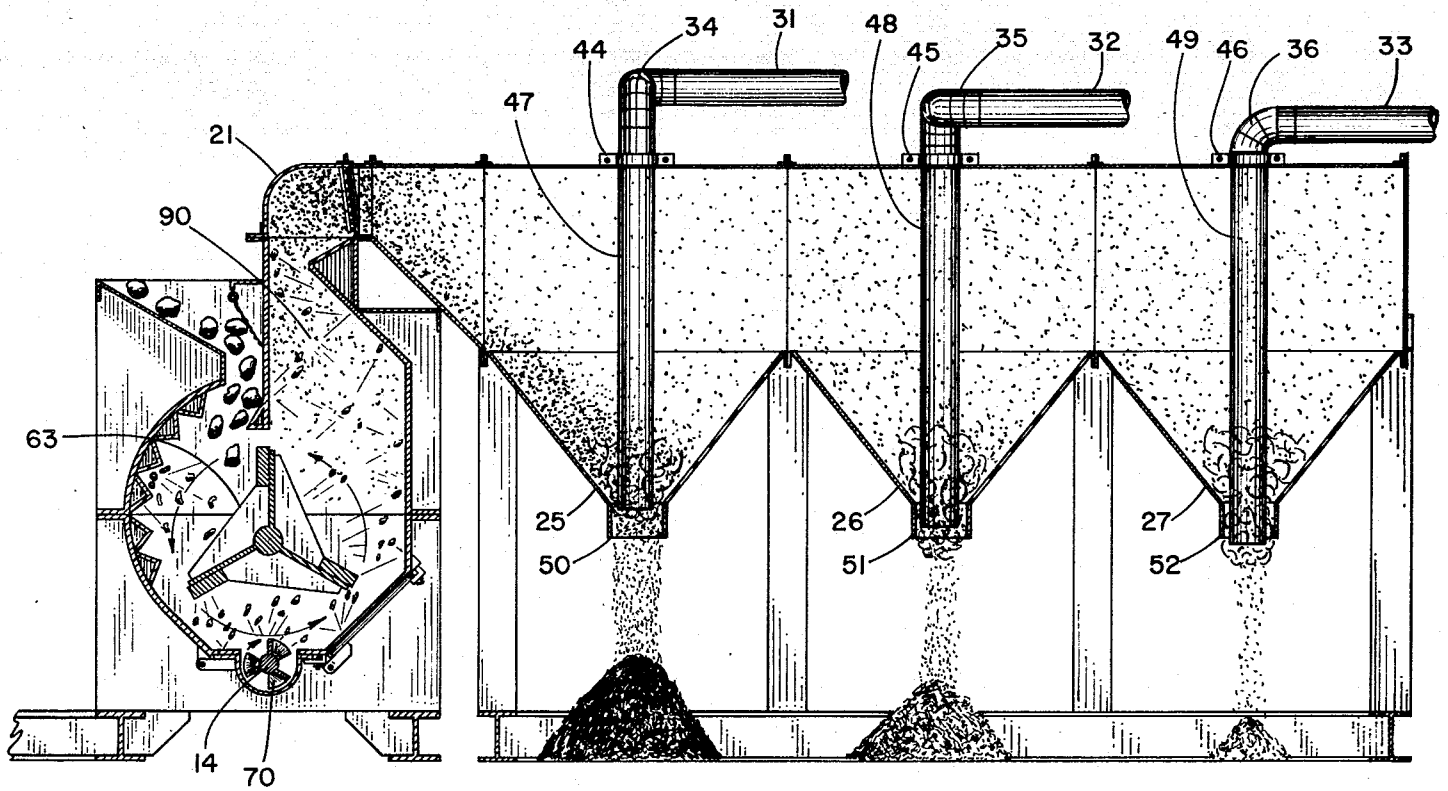
FIG. 2 is a side cross-sectional view of the crusher and bin collection system.
Figure 3:
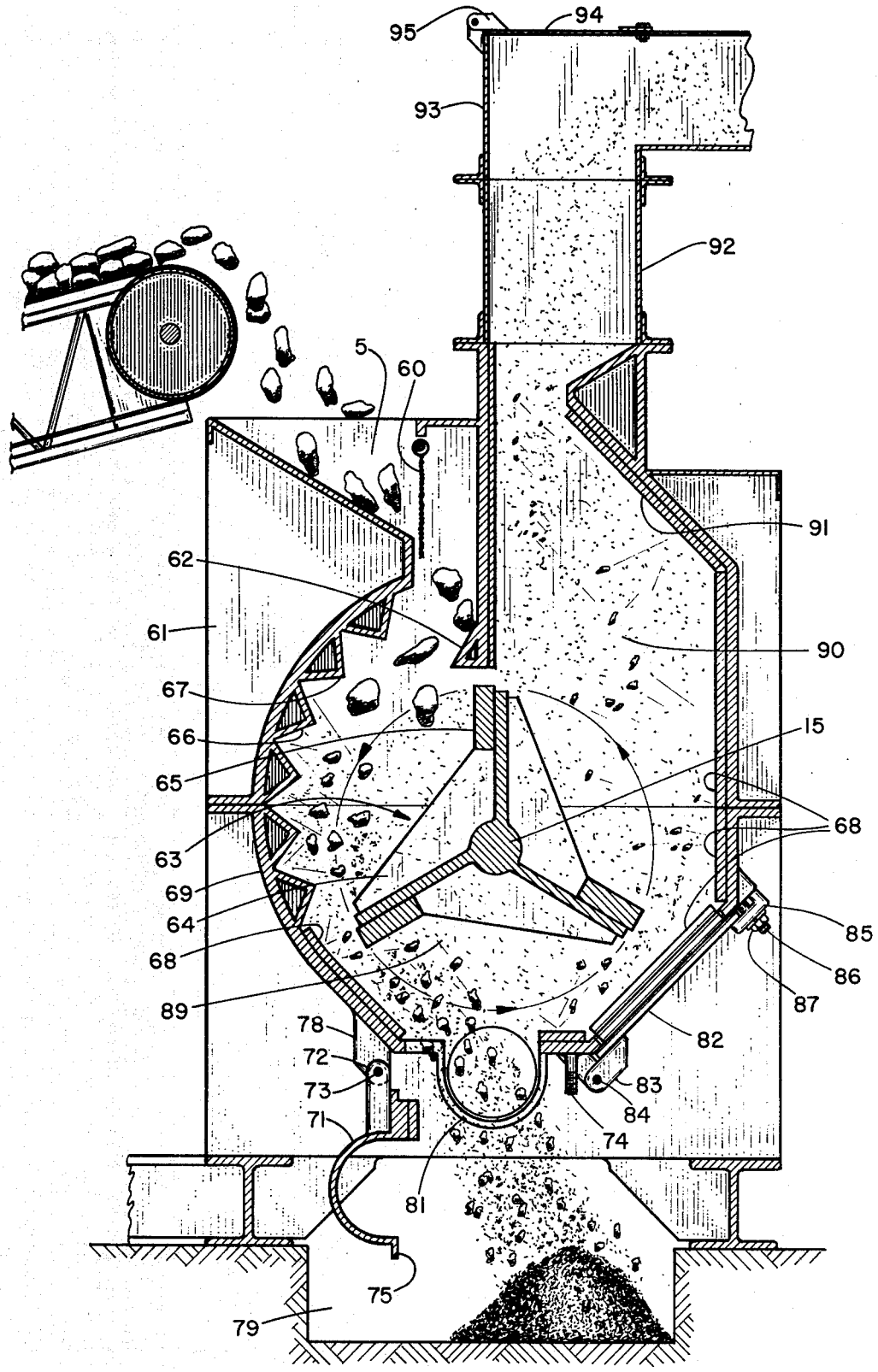
FIG. 3 is a side elevational cross-section view of the crusher in secondary crushing mode.
Figure 4:
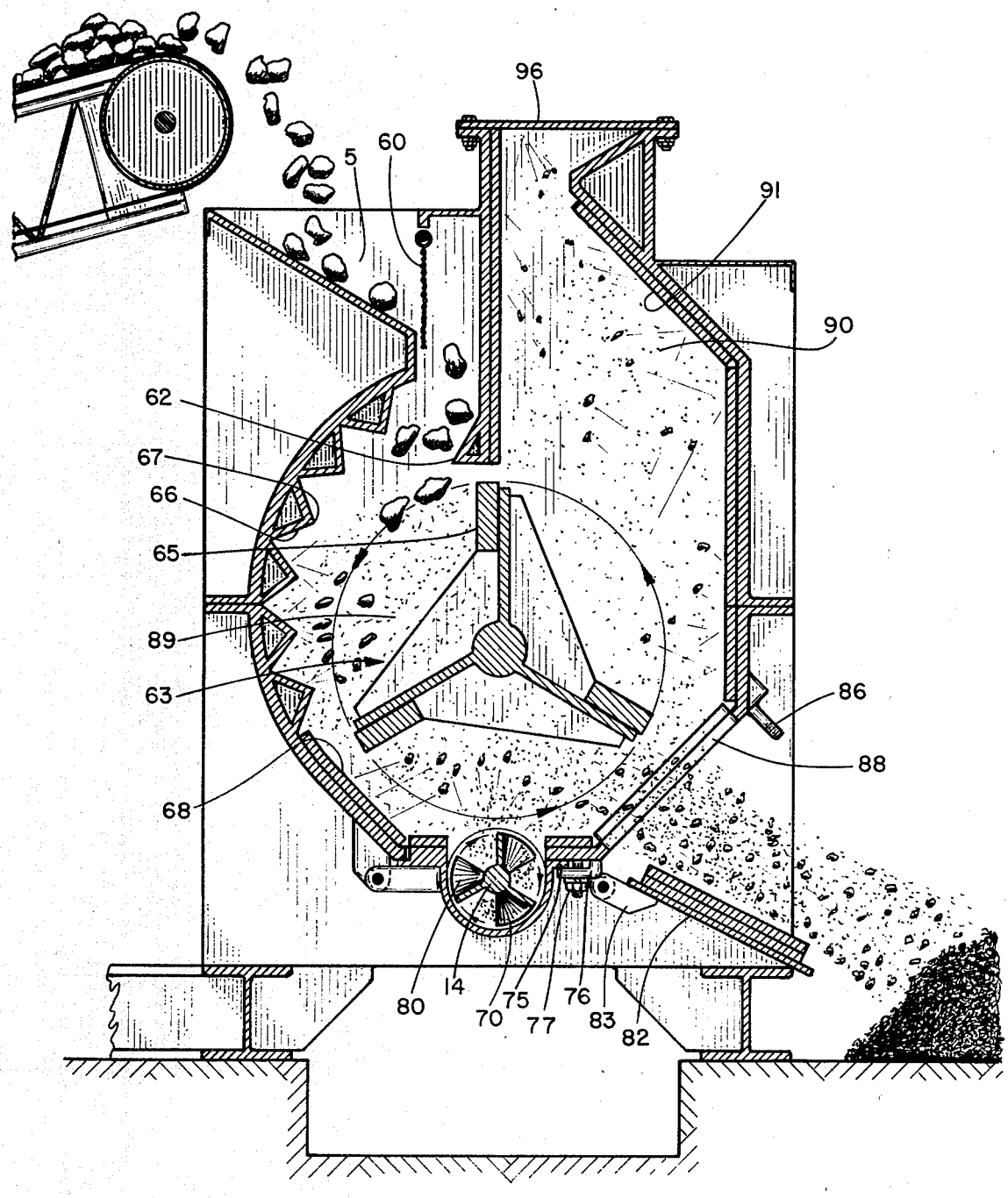
FIG. 4 is a side elevational cross-sectional view of the crusher in tertiary crushing mode.

The crusher has three distinct modes of operation as shown in FIGS. 2 through 4. Conventional primary crushing, which reduces large rocks to −6", is not done in the crusher of the invention. The secondary mode, used on relatively large size feed to effect a relatively small reduction (e.g. from 6" to ¾") is shown in FIG. 3. In this mode, the fluidizing rotor is removed, and feed passes through the inlet chute into the impact reduction chamber 89, impacts with the rotor 63, shatter bar 66, and other particles, and exits from the bottom of the impact reduction chamber into a pit 79 beneath the crusher.

In the tertiary crushing mode, shown in FIG. 4, fluidizing rotor 14 is in place at the bottom of the impact reduction chamber. Trap door or hatch 82 is opened, and crushed product exits through opening 88. In this mode, feed particles having an average size of about 1½" can be ground to product sizes varying from about ⅛" to 30 mesh.

The fine grind mode is shown in FIG. 2, wherein the impact rotor 63 and fluidizing rotor 70 are both actuated, air ducts 16 (see FIG. 1) are opened, and the product is further reduced in attrition chamber 90 prior to passing through header 21 and exits at high velocity and in a horizontal direction into the multi-bin classification system. In the fine grind mode as shown in FIG. 2, product size is generally from 30− to about 200 mesh, and can be further decreased by increasing the height of the attrition chamber. Addition of a 36" vertical section between the top of the attrition chamber and header 21 generates a product between 30 mesh and 200 mesh, and addition of a further 24" chamber creates a product size between 100 mesh and 300 mesh.

Details of the internal construction of the mill of the invention are best seen in FIGS. 3 and 4. Coarse product enters the exit chute and passes through flexible curtain 60 secured at its upper edge to the mill housing. The outer housing wall 61 has an impact rotor 63 mounted on the interior thereof in an impact reduction chamber 89. A diverter bar 62 located at the end of the chute reverses the direction of the incoming feed material, directing the material into the entry side of the impact reduction chamber. Rotor 63 is carried on a shaft 15 which traverses the impact reduction chamber and penetrates the housing wall; it is driven by an engine 7 (see FIG. 1). The rotor, which has hammers 65 mounted at its periphery on support blades 64, revolve rapidly in a counter-clockwise direction. The support blades are preferably constructed in a manner so as to sweep a substantial amount of air to create a high velocity of air upwardly through the attrition chamber toward the collection bins.

Feed particles entering the entry section of the impact reduction chamber fall by gravity against the rotating hammers and blades, and are thrust outwardly against a series of transverse shatterbars 66, each of which has a pointed apex 67, to shatter the ore and reduce the particle size. Particles impacting on the shatterbars and the rotor hammers will also impact the remainder of the wall lining 68 of the impact reduction chamber, causing further size reduction.

In the secondary reduction mode, fluidizing rotor 70 is removed via hinged rotor cover 71, which is attached to the external portion of inner housing wall 69 and flange 78 by hinge 72. The hinged joint is rotatable around hinge pin 73. When the rotor is in place, the rotor cover is closed as shown in FIG. 4. Closure is effected by swinging the cover to the closed position, sliding an L-shaped retaining bracket 76 over threaded lug 74, and fastening the assembly with nut 77. Seal is effected between the rotor cover and lip 81 which depends from the exterior of the crusher housing. With the rotor cover open and the rotor removed, particles may be reduced in size about 8–10 fold very quickly and with a minimal expenditure of energy. Product is collected in pit 79 and can be removed by conventional means.

The tertiary crushing mode is shown in FIG. 4. Ore enters the impact reduction chamber 89 through feed chute 5, and impacts the rotor hammers and the shatterbars in the same manner as heretofore described. In the crusher described herein, small particles tend to accumulate in the bottom portion of the impact reduction chamber. To keep the small particles moving throughout the chamber, the fluidizing rotor unit rotates rapidly and throws the particles back into the impact reduction chamber. The fluidizing rotor comprises a shaft 14 having radially extending removable bars or blades 80 extending along the length of the shaft within the housing. As shown, the fluidizing rotor normally rotates in a counterclockwise direction, but may be reversed if desired. A more detailed view of the blades and hammers for the impact rotor, and of the fluidizing rotor, are found in my U.S. Pat. No. 4,037,796. These designs are conventional, and no invention in a specific rotor design is claimed herein.

In the tertiary mode (FIG. 4), hatch 82 mounted on external housing wall 61 is shown in the open position. The hatch is hingedly mounted at 83 with pin 84, and can be swung downwardly to provide product exit means 88 downstream (i.e., on the opposite side of the impact reduction chamber from the feed inlet) of fluidizing rotor. Closure of the hatch is similar to closure of the rotor cover, and is best seen in FIG. 3. An L-shaped retaining bracket 85 fits over threaded lug 86, with a flange of the bracket extending over the end of the hatch 82 to maintain it in closed position. A fastening nut 87 completes the closure of the unit. Crushed particles exiting the tertiary product exit are crushed to particle sizes intermediate the secondary and fine-grind modes.

In operation of the crusher of the invention both the secondary and tertiary modes, a cover 96 is bolted on the unit at the top of attrition chamber 90, in the manner shown in FIG. 4. FIG. 3 shows an additional extension on the top of the attrition chamber which is not normally used except in the fine-grind reduction mode. In addition, the air vents 16 are closed when operating in the secondary and tertiary modes.

The remaining, and generally most important, operating configuration is the fine crushing configuration shown in FIGS. 1 and 2. As shown in FIG. 2, rotor 70 is in place, and hatch 88 is in the closed position. In this mode of operation, crusher rotor 63 operates at very high speeds, e.g., rotor tip speeds of up to about 9,000 feet per minute, and the fluidizing rotor is actuated to jettison particles which settle by gravity at the bottom of the impact reduction chamber. Particles are swept by a very high air flow upwardly into attrition chamber 90, which is a vertical chamber having a vertically decreasing cross-sectional area formed by inner housing walls 68, 69 and 91. Importantly, the attrition chamber does not contain any diverters or other objects which impede the upward flow of air and particles. Attrition occurs in the attrition chamber by intercontact of rising and falling particles, and by impact of the particles against the chamber walls. Slanted wall 91, which extends at an angle of approximately 45° to horizontal, deflects particles back toward the center of the attrition chamber and toward the mainstream of the rapidly moving vertical air flow. Because of the vertically decreasing cross-section of the attrition chamber, air velocity increases as the air rises approximately inversely proportional to the cross-sectional area. Accordingly, air velocity is maximized at the upper end 97 of the slanted wall of the attrition chamber. As shown in FIG. 3, additional vertical sections such as section 92 may be bolted to the top of the attrition chamber to increase the path of travel of the crushed particles and concomitantly decrease particle size. Depending upon the number of vertical sections bolted on, product particles may range in size from about 50 mesh to −200 mesh.

Actual experience has demonstrated that particles will be in the range of ⅛" to 30 mesh when the attrition chamber is configured as shown in FIG. 2. Addition of a 36" vertical extension to the attrition chamber changes the product size range to about −30 mesh to about −100 mesh. The further addition of a 24" vertical chamber changes the product size range from about −100 mesh to −200 mesh.

At the top of the attrition chamber is a header 93 having a horizontal hinged cover 94 connected at hinge 95. This cover is either closed by a frictional closing or an explosion bolt such that, in the event of an explosion when grinding potentially dangerous products such as coal, the cover acts as a relief valve to release the pressure and prevent damage to expensive components of the crusher and collection system.

Product exits the header, optionally through a screen 98 (shown in FIG. 2) which may knock back any exiting particles larger than a desired size and are thrust into a collection system at very high velocities. At this point, particle velocities may be in the range of 4000 to 8000 f.p.m.; more particularly 5000 to 6000 f.p.m. Whereas in prior art systems the product particles are collected together and separated subsequently by mechanical means (e.g., screening). The collection system of the invention preferably takes advantage of the high air and particle stream velocity to assist in classifying the product. For example, the stream may be used as feed to a conventional cyclone separator, where product enters tangentially and is centrifugally separated, with heavier particles exiting the bottom of the separator and larger particles being carried over into an additional separating means or storage bin. Alternatively, particles may jet into the separation system shown in FIGS. 1 and 2.

As best shown in FIG. 2, the air particle stream passes through optional sieve 98 at high velocity into a series of collection bins 22, 23, and 24 which are positioned adjacent to each other at increasing distances from the attrition chamber exit. Finely divided particles in the product stream shoot across the top portions of the bins and fall by gravity into the lower funnel shaped portions 25, 26 and 27 of the bins. Heavier larger particles drop closest to the attrition chamber outlet, i.e., in bin 25; intermediate sized particles drop into bin 26, and fine particles will carry over into bin 27. By this method of classification, energy produced in the crusher is in effect recovered by using the energy to perform a classification function.

Each of bins 22, 23 and 24 have a cylindrical neck opening at the bottom thereof, identified as product exits 50, 51 and 52. A series of vertical dust suction tubes 47, 48, and 49 extend downwardly into the funnel shaped portions of the bins and into the necks of the bins to collect dust-type particles in the vicinity of the bin exit. Each of the suction tubes are fastened by an adjustable collar 44, 45, and 46 which may be loosened to adjust the height of the suction tube in the bin. The suction tubes are connected by flexible extendable couplings 34, 35, and 36 to horizontal duct sections 31, 32, and 33 which connect to a dust collection system best seen in FIG. 1. The dust collection system consists of a header 37 into which all of the horizontal tubes extend, a funnel shaped portion 38, and a vertical duct leading from the bottom neck portion of section 38 to a suction fan 40 having a variable speed drive which creates a constant flow of air from the collection bins through the header, the suction fan, and into bag house 42 through line 41. The bag house is a conventional dust collection vehicle; any known system for removing extremely fine particles from an air stream may also be used. In general, the fines collected in the bag house may be used or discarded; in crushing limerock, or in the recovery of silver, lead, and zinc, the fines are used or processed, whereas in gold ore recovery, they are usually discarded.

The drive mechanism for the crusher is shown in FIG. 1. Drive engine 7 having control stick 8 drives the fluidizing rotor and the impact reduction rotor through a series of belts and pulleys. Drive belts 9 and 10 transmit rotational motion to pulley 12 attached to the shaft 14 of the fluidizing rotor, and belt 11 transmits power to pulley 13 attached to the drive shaft 15 of the crusher rotor. Of particular importance to the tertiary crushing mode are identical air inlets 16 on opposing sides of the crusher housing which have a damper control 17 for a butterfly valve in the air inlet tube. When the butterfly valve is opened, air is sucked into the crusher at high speeds, and the air velocity through the impact reduction chamber and the attrition chamber is increased to very high rates. The rapidly revolving crusher rotor acts as a giant fan, creating a tremendous velocity of air and particles through the attrition chamber and into the classification chambers. Velocity is controlled to a large extent by controlling the quantity of air passing through the air inlet tubes. Air passes upwardly through the header, shown in FIG. 1 having an outer wall 21, and into the three bins spaced at various distances from the product exit. An access door 30 is located in the center bin 23 to permit maintenance.

For any given crusher, the fineness of crushing depends on the type of material being crushed, the rotor tip speed, and the air velocity. Air velocity is controlled by adjustment of the air intake flaps 17. The following table illustrates specific examples of crushing in the fine grind mode at various air and rotor speeds.

| Material | Air Velocity f.p.m. | Rotor Tip Speed f.p.m. | Particle Size Range |
|---|---|---|---|
| Mineral-bearing Quartz | 4000 | 6000 | ⅛"−30 mesh |

-continued

| Material | Air Velocity f.p.m. | Rotor Tip Speed f.p.m. | Particle Size Range |
|---|---|---|---|
| Limerock | 4000 | 6000 | 30-60 mesh |
| Galena | 4000 | 6000 | 30-100 mesh |
| Quartz | 5000 | 7500 | 30-60 mesh |
| Limerock | 5000 | 7500 | 60-100 mesh |
| Galena | 5000 | 7500 | 100-150 mesh |
| Quartz | 7000 | 9000 | 60-100 mesh |
| Limerock | 7000 | 9000 | 100-200 mesh |
| Galena | 7000 | 9000 | 100-200 mesh |
| Coal | 7000 | 9000 | 100-250 mesh |

As the rotor tip speed approaches about 12,000 f.p.m., the air intake for the equipment tested begins to become relatively constant.

During operation in the fine crushing mode, product passes through the necks 50, 51, and 52 of the collection bins where it may be collected in any suitable container, such as barrels or hoppers, or on conveyor belts which may carry the materials to other containers, such as freight cars. Because of the dust collection system, these heavier particles falling through the bin necks are generally relatively dust free.

Depending on the height of the attrition chamber, it has normally been found from operating experience that material having a size range from about −30 mesh to +50 mesh is normally collected in the first bin 22. In the second bin, particle size ranges from approximately −50 to about −150 mesh; extremely fine particles, i.e., +150 mesh, are picked up in the third bin. The dust particles are sucked up through the tubes 47, 48, and 49 for final collection at the bag house. By adjusting the depth of the tube in the bin neck and by controlling the speed of the suction of the updraft fan 40, the size of particles drawn into the dust collection system may be controlled.

An alternative to the three bin collection system is a solid/gas cyclone. These are conventional, commercially available units which may be equipped with a suction tube having an adjustable depth and a variable speed suction fan in the same manner as is shown in the collection bins in FIGS. 1 and 2. Similarly, the fine particles are drawn through the suction tube and collected in a bag house. As an alternative to the single blower system shown in FIG. 1, each of the suction tubes 31, 32, and 33 may be attached to separate suction fans and separate cyclones. By adjusting the height of each of the tubes and the amount of air drawn through the tubes, additional classification of extremely fine particles may be accomplished.

Figure 5:
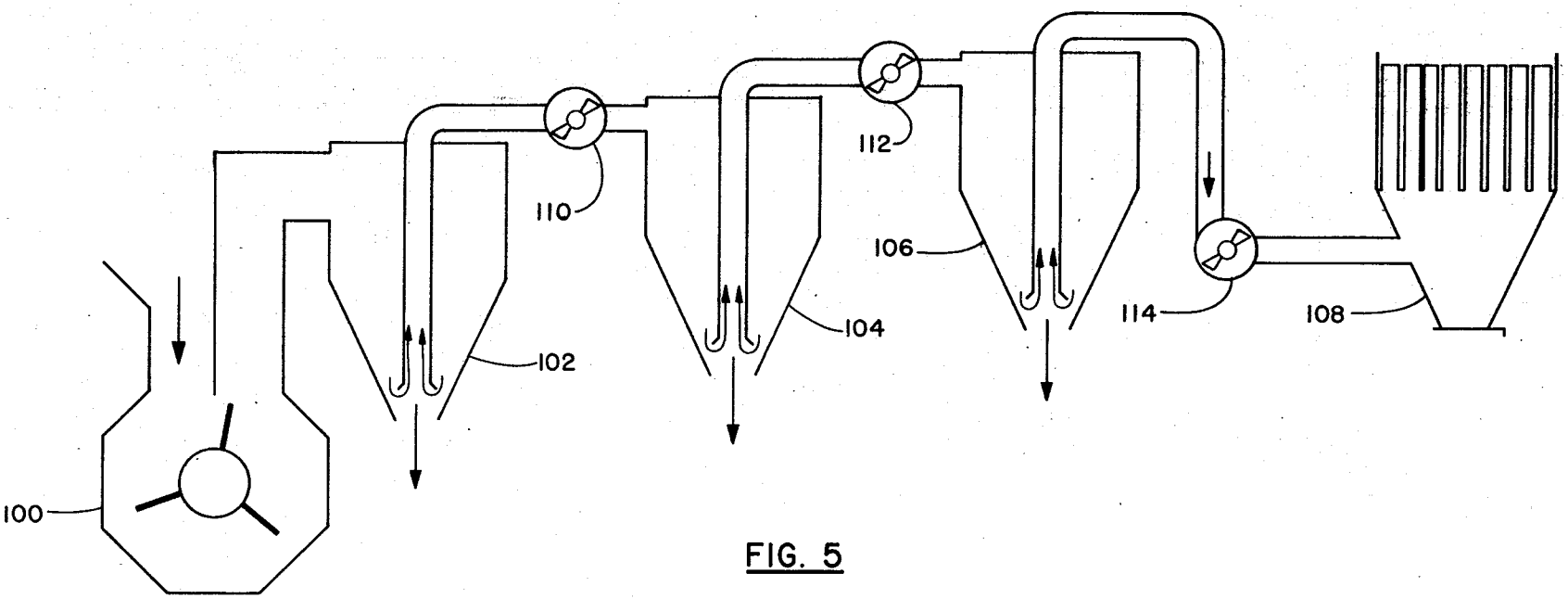
FIG. 5 is a schematic diagram of a fine-grind collection system using the centrifugal separators.

Another embodiment of the invention shown in FIG. 5 is a crusher 100 operating in the fine-grind mode with recovery effected in a series of cyclones 102, 104, and 106. Product exits the crusher and enters the first cyclone, with the particles traversing the interior perimeter of the cyclone and gravitating toward the lower opening. Coarse product drops through the opening, and finer product and air are sucked through the vertical tube via variable-speed suction fan 110. Similar separations are made in cyclones 104 and 106, with variable speed fans 112 and 114 controlling product size. Very fine dust is sent to bag house 108.

This method is particularly useful where a number of different product gradations are needed, e.g., for fertilizer lime; by controlling fan speed, product size distribution can be closely controlled. In addition, this control can be used to substantially reduce the size of the bag house which is normally required to handle all of the fines.

Many modifications to the invention within its spirit and scope will be apparent to those skilled in the art; the description of the specific embodiment herein should not be construed as limiting. Accordingly, the invention should be defined only by the following claims.

I claim:

1. In an apparatus for crushing solid particles having a housing, inlet means for passing material to be crushed into an impact reduction chamber, an impact reduction chamber within the housing, an impact rotor having impact hammers at its periphery, drive means to rotate the impact rotor, a fluidizing rotor removably mounted near the bottom of the impact reduction chamber, and drive means to rotate the fluidizing rotor, the improvement therein which comprises an attrition chamber extending from the impact reduction chamber vertically above the impact rotor, first product exit means located at the bottom of the impact reduction chamber, second product exit means located in a lower portion of the housing opposite the inlet means and generally adjacent to the first product exit means, third product exit means located at an upper portion of the attrition chamber, and first, second, and third closure means to selectively close the first, second, and third product exit means.

2. The apparatus of claim 1 also comprising air inlet means for permitting air flow into the impact reduction chamber, and control means for selectively varying the air flow into the chamber.

3. The apparatus of claim 1 wherein the attrition chamber is unobstructed and has a vertically decreasing cross-sectional area at an upstream portion thereof such that air traversing the attrition chamber increases in velocity along said chamber.

* * * * *